US007568956B1

(12) United States Patent
Tseng

(10) Patent No.: US 7,568,956 B1
(45) Date of Patent: Aug. 4, 2009

(54) LED ILLUMINATOR

(76) Inventor: Wei-Jen Tseng, 5F, No. 10, Lane 23, Tungshan St., Hsinchu City (TW)

( * ) Notice: Subject to any disclaimer, the term of this patent is extended or adjusted under 35 U.S.C. 154(b) by 0 days.

(21) Appl. No.: 12/177,699

(22) Filed: Jul. 22, 2008

(51) Int. Cl.
*H01R 24/00* (2006.01)

(52) U.S. Cl. ..... 439/699.2; 439/619; 362/654

(58) Field of Classification Search ..... 439/619, 439/699.1, 699.2; 362/226, 249, 654
See application file for complete search history.

(56) References Cited

U.S. PATENT DOCUMENTS 6,142,646 A * 11/2000 Liu ..... 362/652
6,200,169 B1 * 3/2001 Tseng ..... 439/699.1
6,283,797 B1 * 9/2001 Wu ..... 439/699.2
6,347,965 B1 * 2/2002 Pan ..... 439/699.2
7,178,970 B2 * 2/2007 Chiu ..... 362/654
7,351,092 B2 * 4/2008 Tseng ..... 439/418
7,422,489 B1 * 9/2008 Tseng ..... 439/699.2
2003/0119374 A1 * 6/2003 Wang ..... 439/699.1
2006/0258222 A1 * 11/2006 Tseng ..... 439/620.1
2008/0124984 A1 * 5/2008 Li ..... 439/699.2

* cited by examiner

*Primary Examiner*—James Harvey
(74) *Attorney, Agent, or Firm*—Apex Juris, pllc; Tracy M Heims

(57) ABSTRACT

An LED illuminator has an LED, a sleeve, a housing, a first wire and a second wire. The LED has a lens and two leg-plates being conductive, substantially flat and connected to the lens and comprising a fore leg-plate and a rear leg-plate. The sleeve is an open container mounted around the LED and comprising an opening being mounted around the lens, a fore mounting hole mounted around the fore leg-plate and a rear mounting hole being mounted around the rear leg-plate. The housing receives the sleeve and has an opening, a fore terminal channel and a rear terminal channel. The first wire has a first terminal being mounted in the fore terminal channel and the second wire has a second terminal being mounted in the rear terminal channel. Each wire respectively contacts the leg-plates electrically.

14 Claims, 13 Drawing Sheets

LED ILLUMINATOR

BACKGROUND OF THE INVENTION

1. Field of the Invention

The present invention relates to an illuminator, especially to an LED (light-emitting diode) illuminator.

2. Description of the Prior Art

A conventional LED illuminator is used to offer low-light illumination or for interior decoration and comprises two wires, a housing, a sleeve and a luminant device. Each of the wires has a terminal. The terminal is mounted inside the housing. The sleeve is inserted into the housing and has an outer surface and an inner surface. The ruminant device may be a bulb or an LED and has two legs. Each leg is needle-shaped and has a distal portion and an outer surface. The leg is mounted in the sleeve and the distal portion is laterally bent to the outer surface. When the sleeve is inserted in the housing, the distal portions of the legs respectively contact the terminals of the wires.

However, recent LED design has replaced conventional needle-shaped legs with leg-plates. To bend the leg-plates laterally is extremely inconvenient and difficult, making it almost impossible to fit a newly designed LED in a conventional sleeve and a conventional housing.

In addition, a conventional leg is structurally weak, making precisely positioning conventional legs in a sleeve difficult. Accidentally hitting the inner surface of the sleeve may also break or bend the legs unexpectedly. Therefore, the complexity and cost of the assembling process is unnecessary raised by the aforementioned issues.

Furthermore, the outer surface of a conventional leg is much smaller than that of a leg-plate, causing misalignment or poor contact with the terminals.

To overcome the shortcomings, the present invention provides an LED illuminator to mitigate or obviate the aforementioned problems.

SUMMARY OF THE INVENTION

The main objective of the invention is to provide an LED illuminator.

The LED illuminator in accordance with the present invention has an LED, a sleeve, a housing, a first wire and a second wire. The LED has a lens and two leg-plates being conductive, substantially flat and connected to the lens and comprising a fore leg-plate and a rear leg-plate. The sleeve is an open container mounted around the LED and comprising an opening being mounted around the lens, a base, a fore mounting hole mounted around the fore leg-plate, a rear mounting hole being mounted around the rear leg-plate, a fore mounting guide corresponding to the fore mounting hole and a rear mounting guide corresponding to the rear mounting hole. The housing receives the sleeve and has an opening, a fore terminal channel and a rear terminal channel. The first wire has a first terminal being mounted in the fore terminal channel and the second wire has a second terminal being mounted in the rear terminal channel. Each wire respectively contacts the leg-plates electrically.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
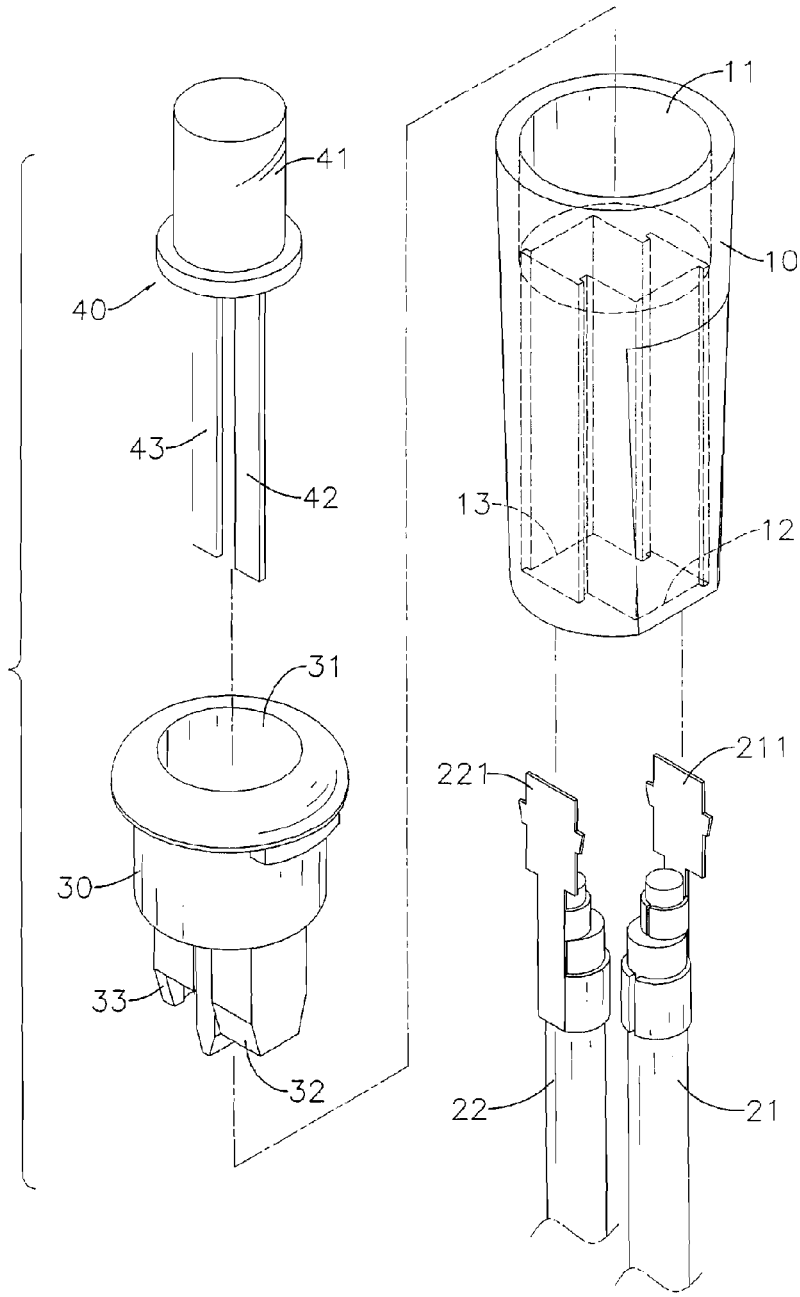
FIG. 1 is an exploded perspective view of a first embodiment of an LED illuminator in accordance with the present invention.
Figure 2:
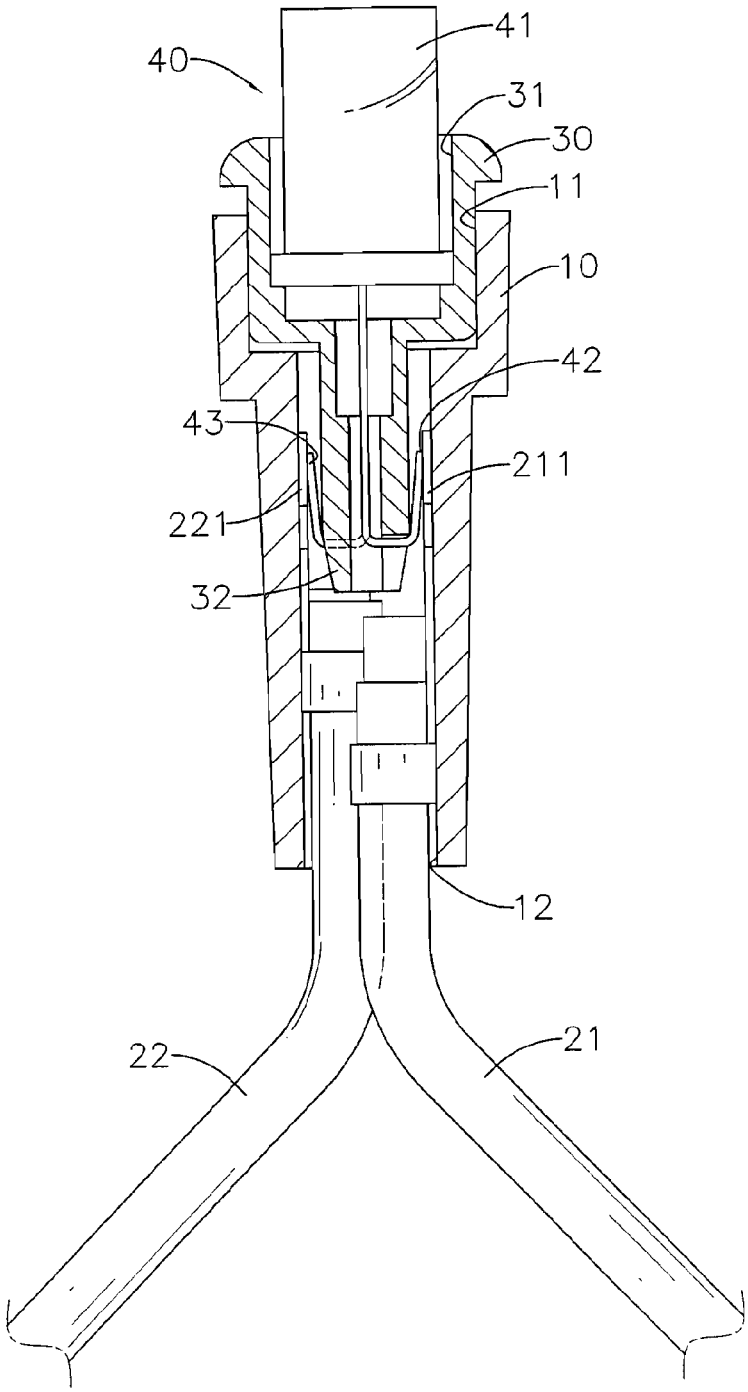
FIG. 2 is a side view in partial section of the LED illuminator in FIG. 1.
Figure 3:
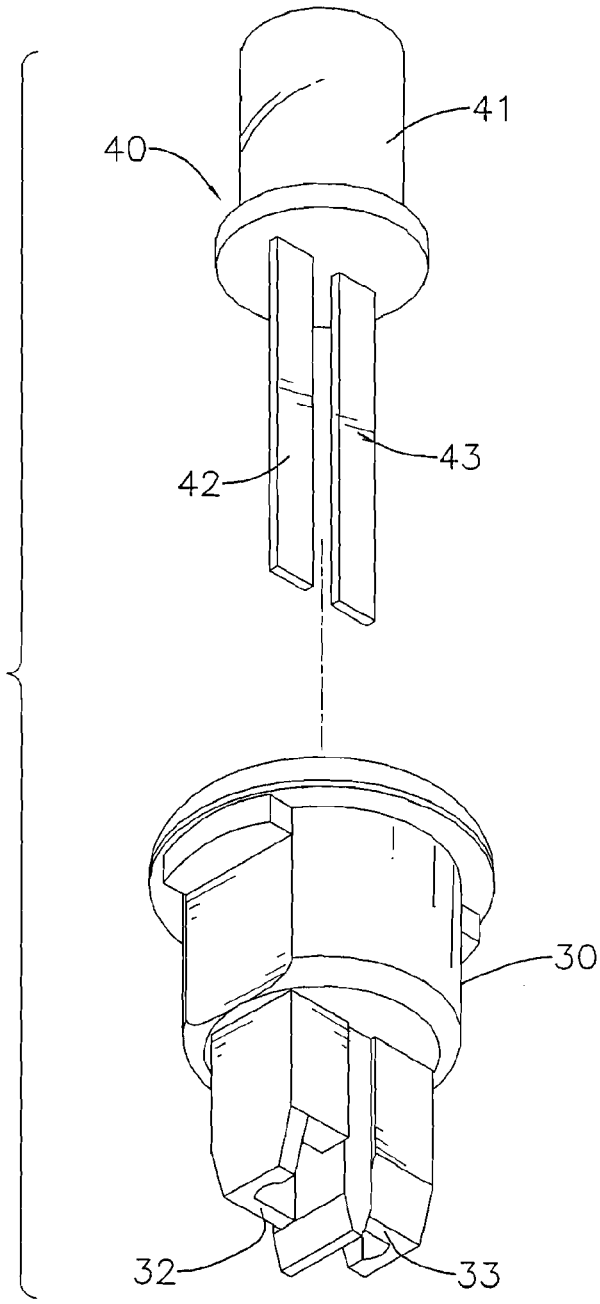
FIG. 3 is an exploded perspective view of an LED and a sleeve of the LED illuminator in FIG. 1.
Figure 4:
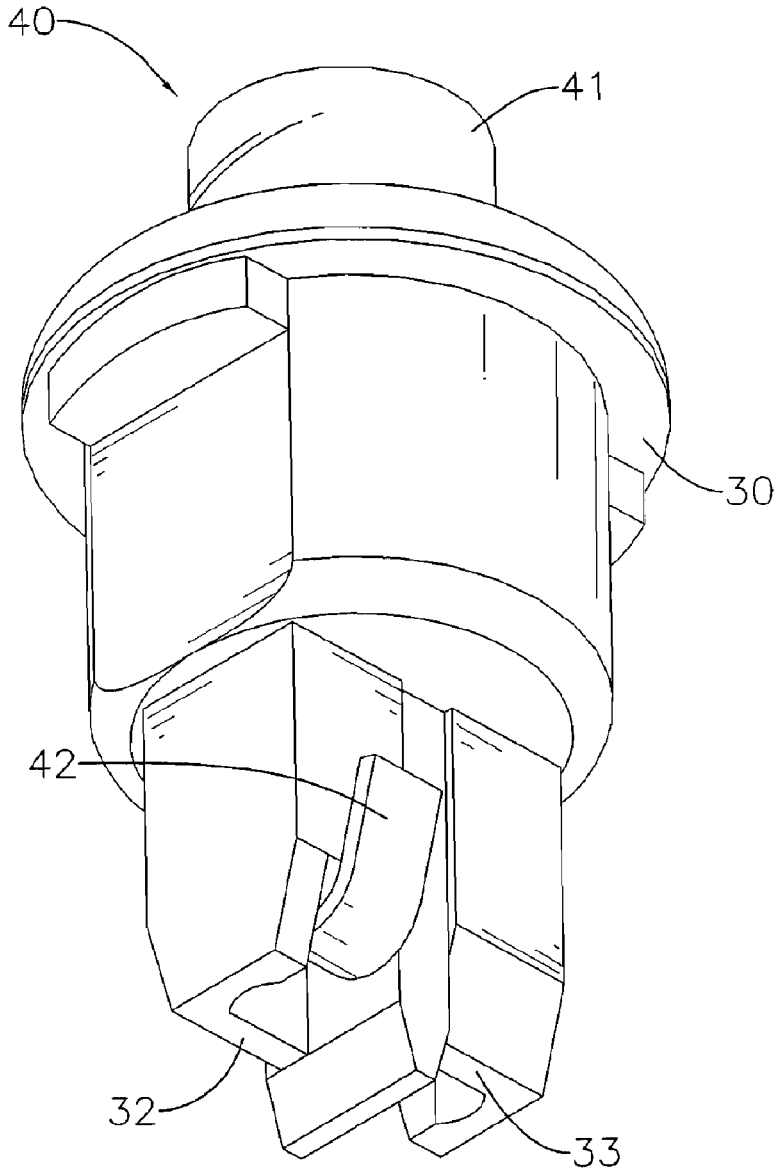
FIG. 4 is an enlarged perspective view of the LED and the sleeve in FIG. 3.
Figure 5:
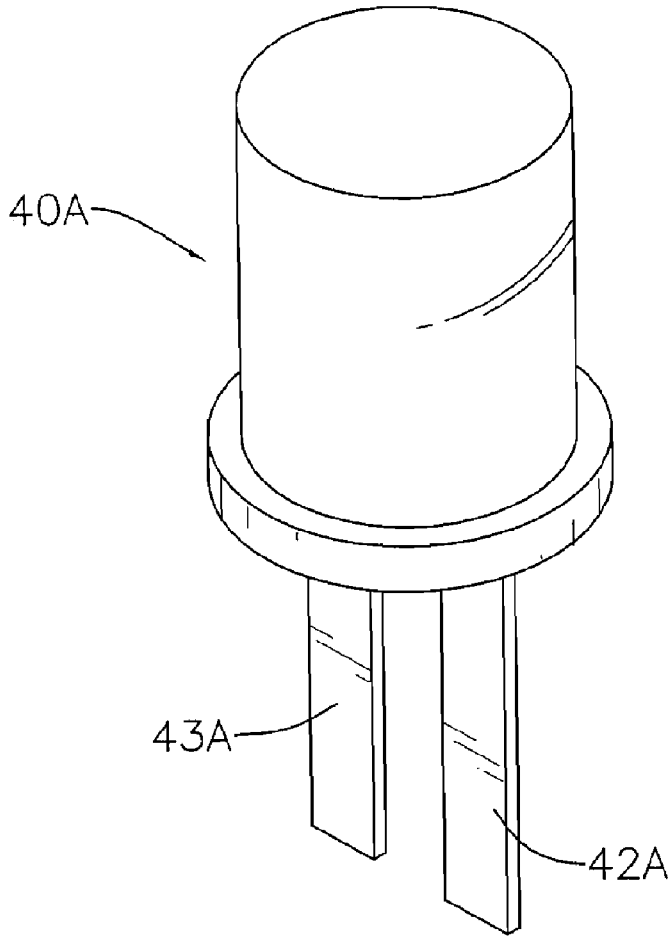
FIG. 5 is a perspective view of an LED of a second embodiment of the LED illuminator in accordance with the present invention.
Figure 6:
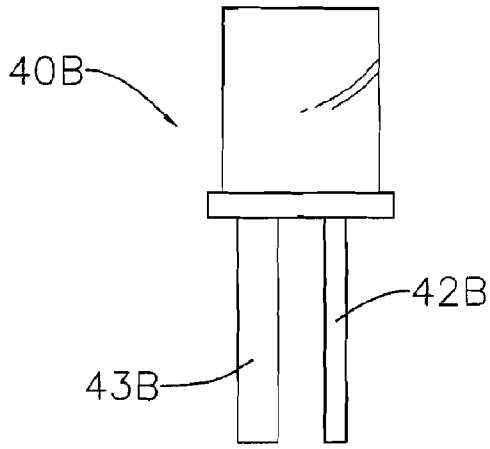
FIG. 6 is a rear view of an LED of a third embodiment of the LED illuminator in accordance with the present invention.
Figure 7:
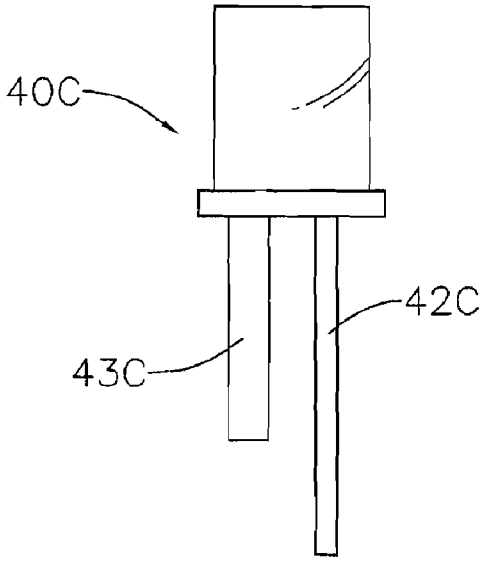
FIG. 7 is a rear view of an LED of a fourth embodiment of the LED illuminator in accordance with the present invention.
Figure 8:
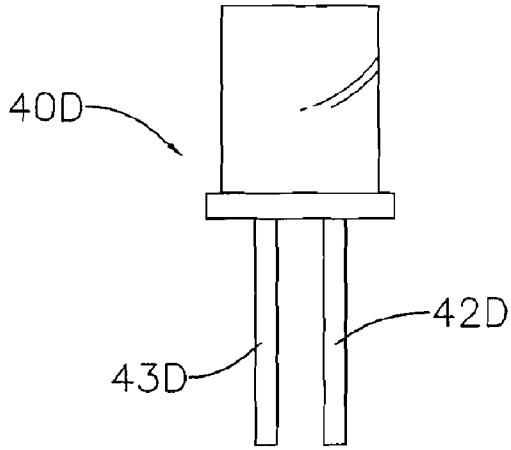
FIG. 8 is a rear view of an LED of a fifth embodiment of the LED illuminator in accordance with the present invention.
Figure 9:
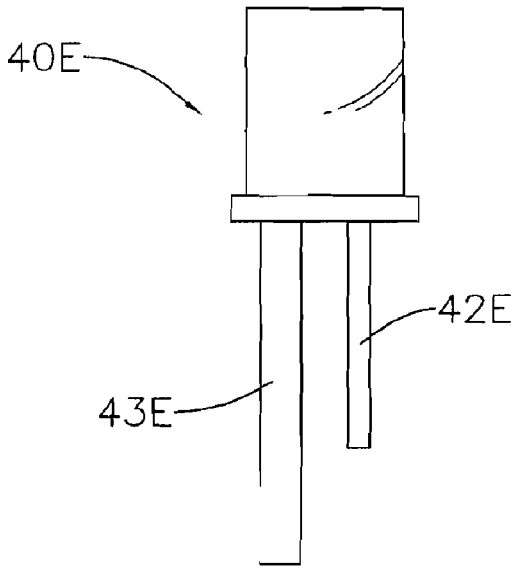
FIG. 9 is a rear view of an LED of a sixth embodiment of the LED illuminator in accordance with the present invention.
Figure 10:
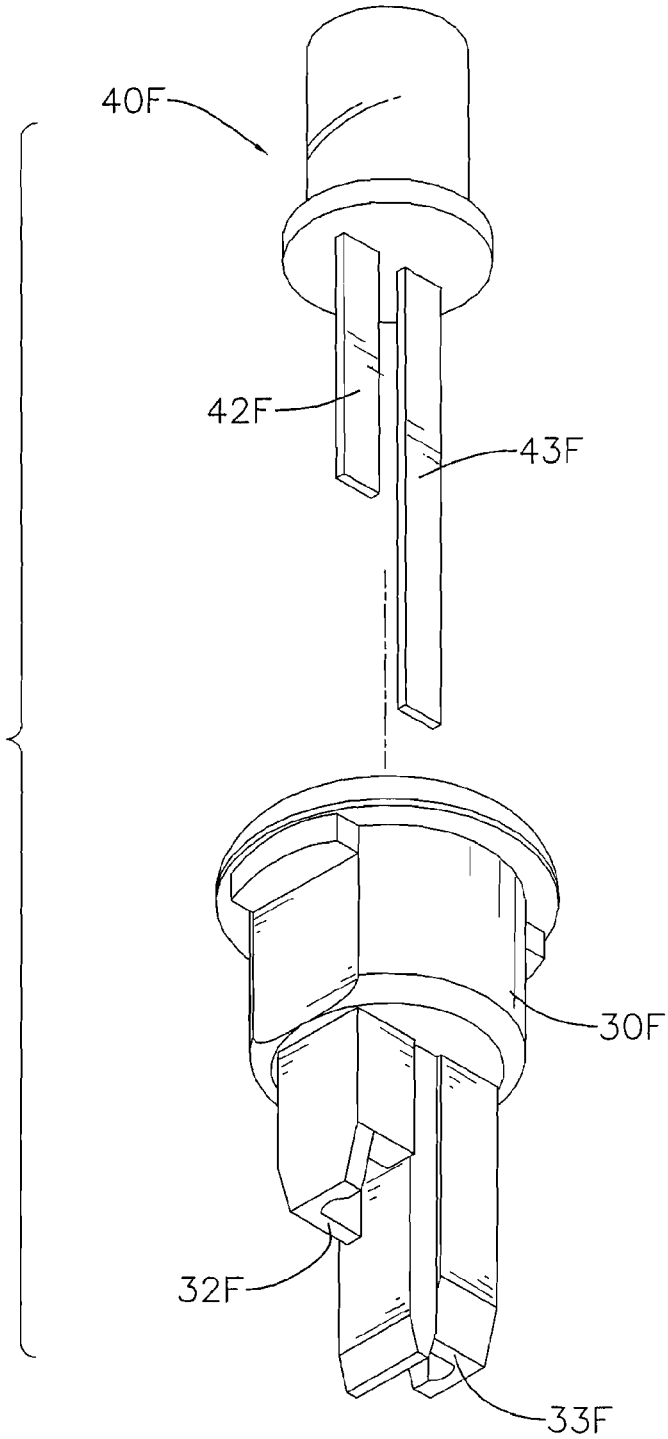
FIG. 10 is an exploded perspective view of an LED and a sleeve of a seventh embodiment of the LED illuminator in accordance with the present invention.
Figure 11:
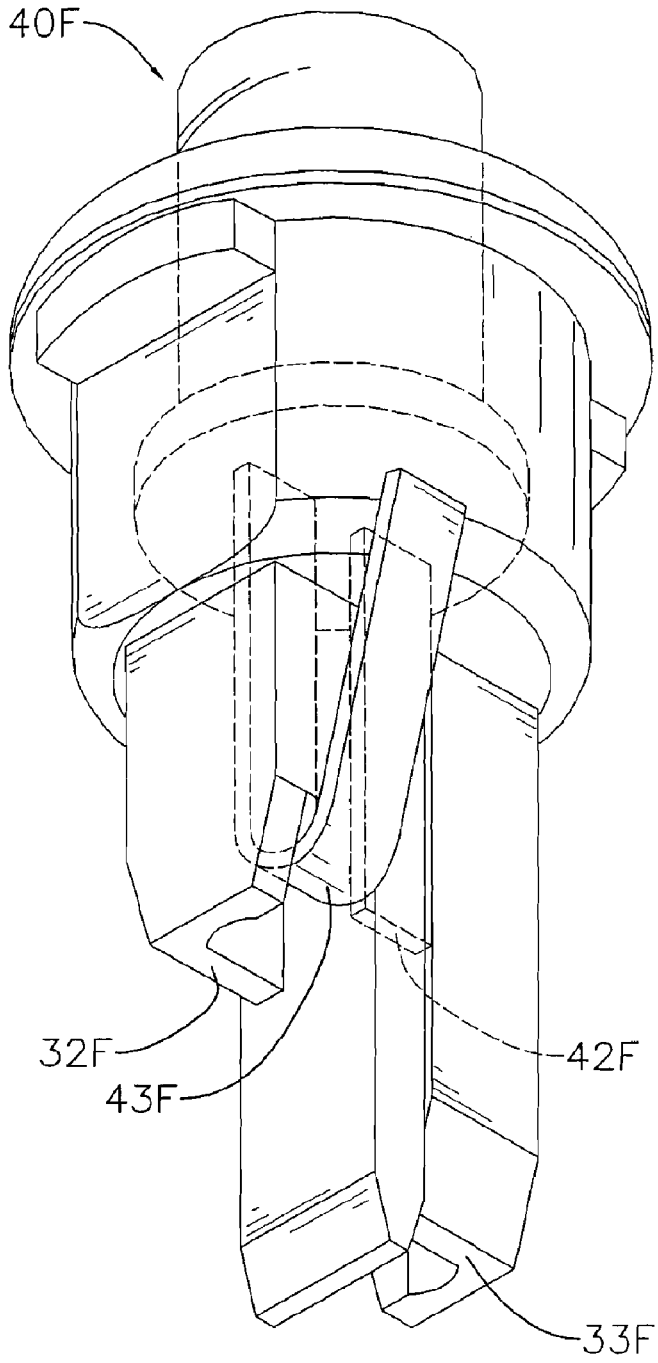
FIG. 11 is a perspective view of the LED and the sleeve in FIG. 10, the LED being shown in phantom lines.
Figure 12:
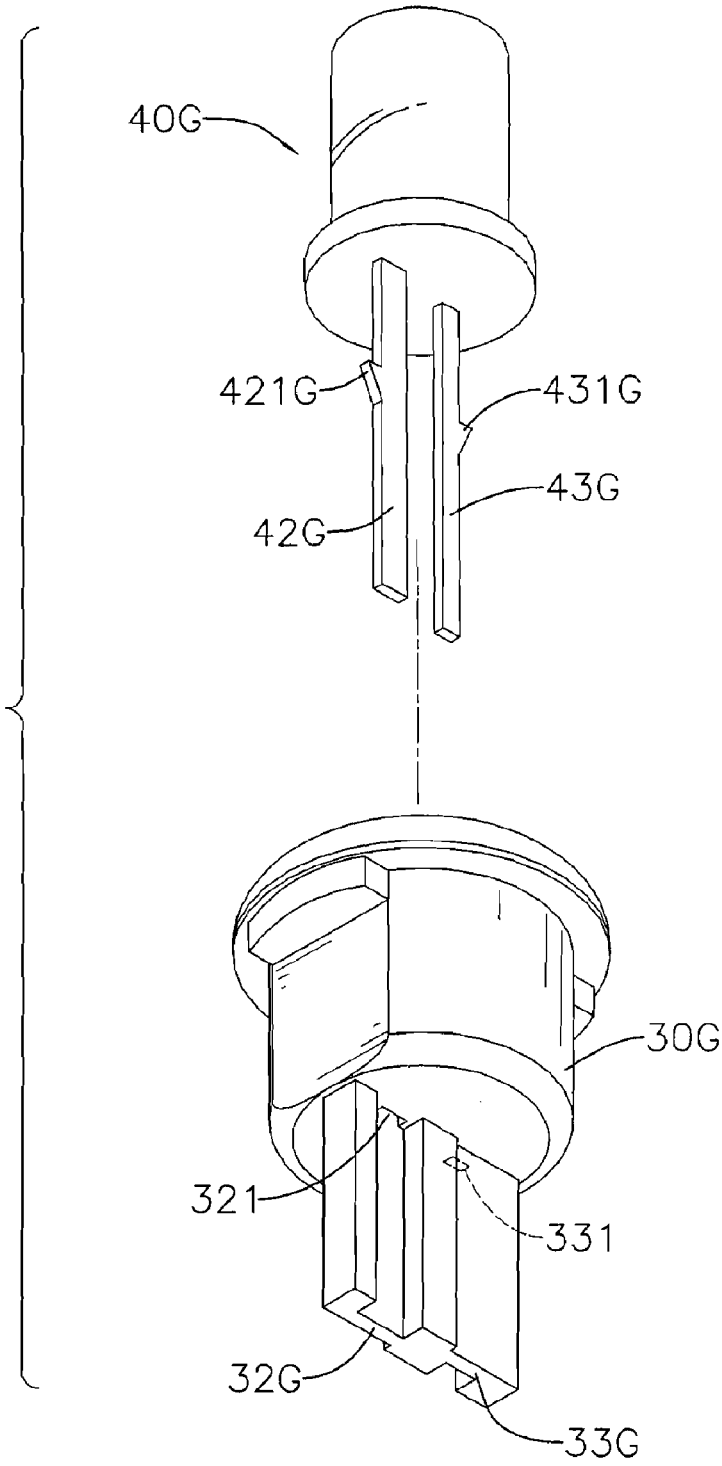
FIG. 12 is an exploded perspective view of an LED and a sleeve of an eighth embodiment of the LED illuminator in accordance with the present invention.
Figure 13:
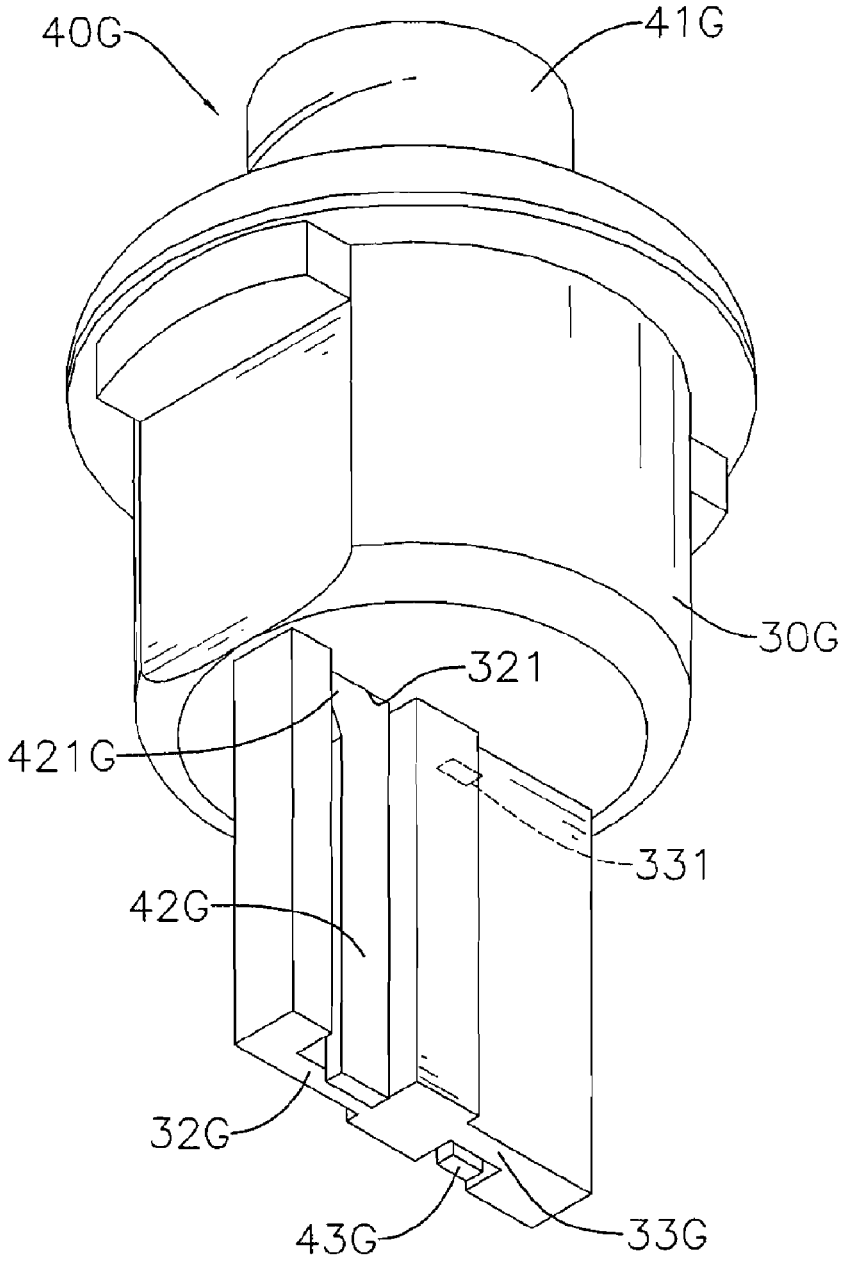
FIG. 13 is a perspective view of the LED and the sleeve in FIG. 12.
Figure 14:
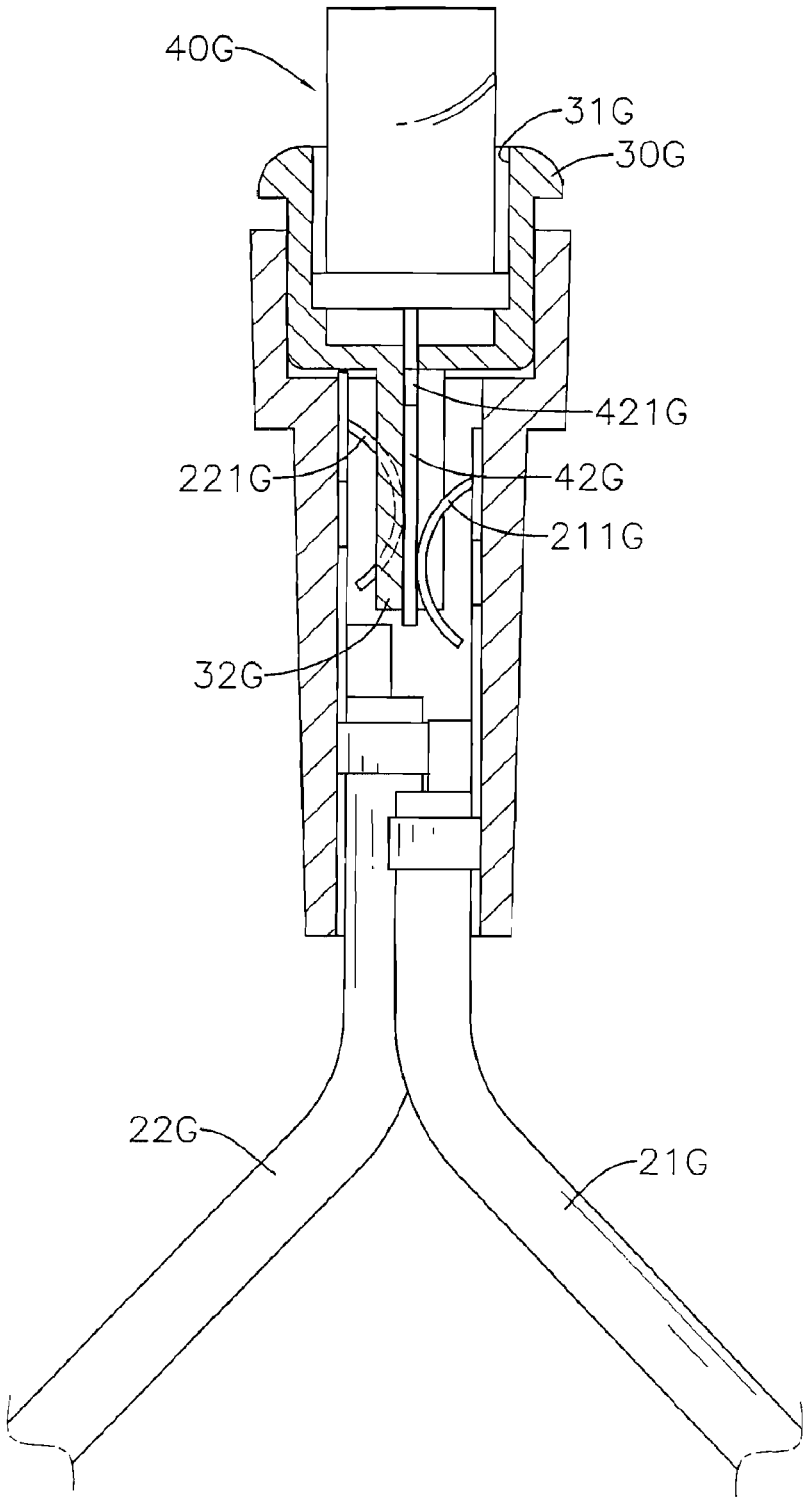
FIG. 14 is a side view in partial section of the LED illuminator in FIG. 12.
Figure 15:
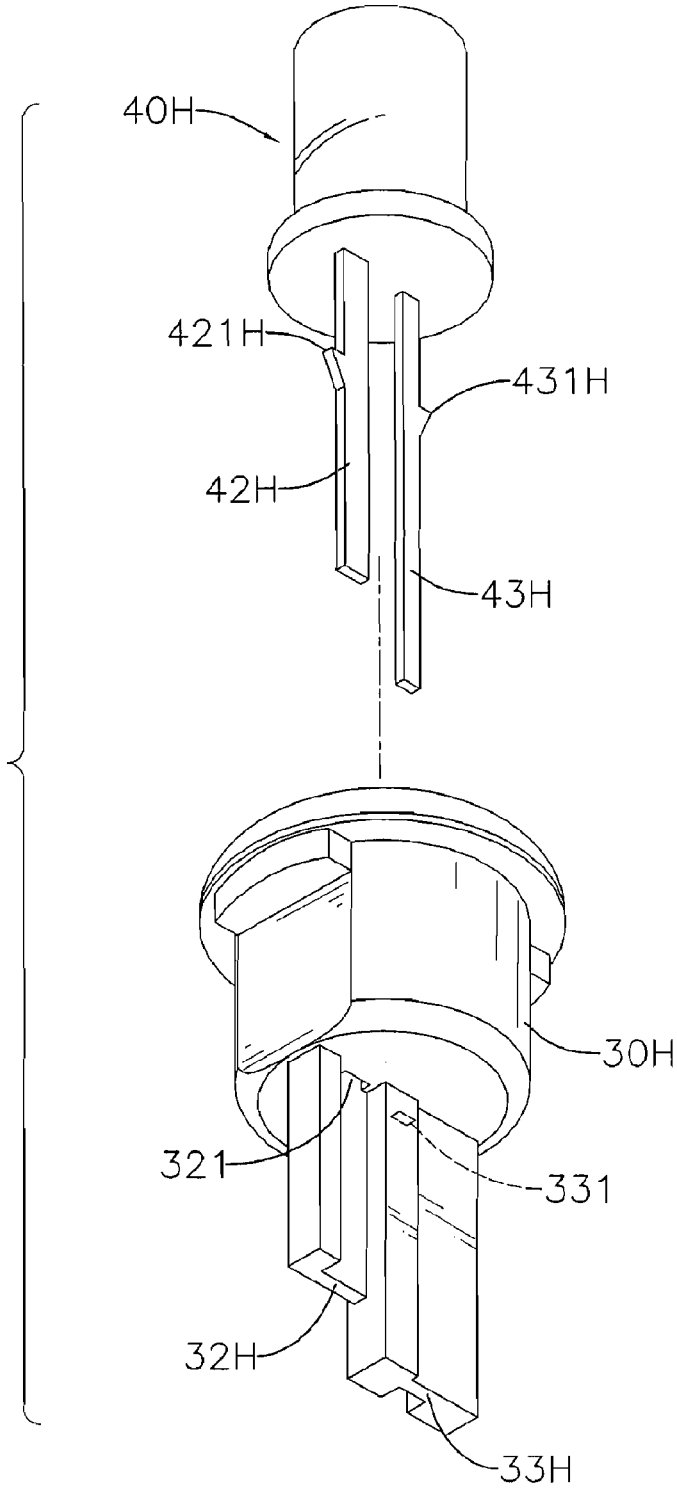
FIG. 15 is an exploded perspective view of an LED and a sleeve of a ninth embodiment of the LED illuminator in accordance with the present invention.

With reference to FIGS. 1 and 2, a light emitting diode (LED) illuminator in accordance with the present invention comprises an LED (40), a sleeve (30), a housing (10), a first wire (21) and a second wire (22).

With further reference to FIGS. 5 to 10, 12 and 15, the LED (40, 40A, 40B, 40C, 40D, 40E, 40G, 40H) comprises a lens (41) and two leg-plates (42, 43). The lens (41) emits light and may be substantially cylindrical. The leg-plates (42, 43) are conductive, substantially flat, connected to the lens (41) to supply power, may be a fore leg-plate (42) and a rear leg-plate (43) and each leg-plate (42, 43) has a length, a width, a distal portion and an optional boss (421G, 431G). The lengths and widths of the leg-plates (42A, 43A) may be the same. The lengths of the leg-plates (42B, 43B) may be the same and the widths may be different. The widths of the leg-plates (42F, 43F) may be the same and the lengths may be different. The lengths and the widths of the leg-plates (42C, 43C) may be different. The distal portions of the leg-plates (42, 43) may be respectively bent forwards and backwards over the fore and rear leg-plates (42, 43). The bosses (421G, 431G) may be formed on and protrude on a same plane from the leg-plates (42G, 43G) adjacent to the lens (41).

With further reference to FIGS. 3, 4, 11 and 13, the sleeve (30, 30A, 30B, 30C, 30D, 30E, 30F, 30G, 30H) is an open container mounted around the LED (40) and has an opening (31), a base, a fore mounting hole (321), a rear mounting hole (331), a fore mounting guide (32), a rear mounting guide (33) and a partition.

The opening is mounted around the lens (41). The fore mounting hole (321) is formed through the base and is mounted around the fore leg-plate (42).

The rear mounting hole (331) is formed through the base, adjacent to the fore mounting hole (321) and is mounted around the rear leg-plate (43). The fore mounting guide (32) corresponds to the fore mounting hole (321), is formed on and protrudes from the base, may be beveled and has a fore mounting channel.

The fore mounting channel is formed through the fore mounting guide (32), communicates with the fore mounting hole (321) and the opening (31) and may be bigger than the fore mounting hole (321) and is mounted around and holds the fore leg-plate (42) securely.

The rear mounting guide (33) corresponds to the rear mounting hole (331), is formed on and protrudes from the base, may be beveled and has a rear mounting channel.

The rear mounting channel is formed through the rear mounting guide (33), communicates with the rear mounting hole (331) and the opening (31), may be bigger then the rear mounting hole (331) and faces away from the fore mounting channel and is mounted around and holds the rear leg-plate (43) securely.

When the leg-plates (42G, 42H, 43G, 43H) are implemented with bosses (421G, 421H, 431G, 431H), the bosses (421G, 421H, 431G, 431H) abut the base of the sleeve (30G, 30H) respectively adjacent to the fore and rear mounting holes (321, 331) to prevent the LED (40, 40H) from being removed from the sleeve (30G, 30H).

The partition is formed on and protrudes from the base between the fore and rear mounting channels and may be beveled.

When the LED leg-plates (42, 43) are bent, the mounting guides (32, 33) are beveled to allow the legs to be bent up and against an outer surface of the mounting guides (32, 33). The partition is also beveled. Furthermore, the bent leg-plates (42, 43) prevent the LED from being accidentally removed.

When the LED leg-plates (42G, 43G) are implemented as straight, namely, not bent, the mounting guides (32, 33) are substantially cuboidal and the partition is also substantially cuboidal. Furthermore, the bosses (421G, 431G) prevent the LED from being accidentally removed.

When the LED leg-plates (42F, 43F) are different lengths, the mounting guides (32F, 33F) are different lengths corresponding to the respective leg-plate (42F, 43F), therefore, should the LED (40F) be mounted incorrectly in the sleeve (30F), this manufacturing error is easily realized and rectified.

When the LED leg-plates (42G, 43G) are different widths, the mounting guides (32G, 33G) are different widths corresponding to the respective leg-plate (42G, 43G), therefore, should the LED (40G) be mounted incorrectly in the sleeve (30F), this manufacturing error is easily realized and rectified.

The housing (10) receives the sleeve (30) and has an opening (11), a fore terminal channel (12) and a rear terminal channel (13) and may further comprise terminal recesses. The opening is formed in the housing (10) and may be round. The fore terminal channel (12) and the rear terminal channel (13) communicate with each other and the opening and each has an inner surface. The terminal recesses are oppositely formed respectively in the inner surfaces of the fore and rear terminal channels (12, 13) and are wider than and communicate respectively with the fore and rear terminal channels (12, 13).

The first wire (21) has an end and a first terminal (211). The first terminal (211) is mounted securely on the end of the first wire (21) and is mounted in the fore terminal channel (12), may be in the terminal recess of the fore terminal channel (12) and electrically contacts a corresponding leg-plate (43) of the LED (40) and the first terminal (211G) may have an arced portion formed on and protruding from the first terminal (211G).

The second wire (22) has an end and a second terminal (221). The second terminal (221) is mounted securely on the end of the second wire (22) and is mounted in the rear terminal channel (13), may be in the terminal recess of the fore terminal channel and electrically contacts a corresponding leg-plate (43) of the LED (40) and the second terminal (221G) may have an arced portion formed on and protruding from the second terminal (221G).

When the LED leg-plates (42G, 43G) are implemented straight, the arced portion of the terminals (212G, 221G) easily contact the leg-plates (42G, 43G) and facilitate in holding the LED (40G) and sleeve (30G) in the housing (10).

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An LED illuminator comprising an LED comprising a lens; and two leg-plates being conductive, substantially flat and connected to the lens and comprising a fore leg-plate comprising a length;

a width; and a distal portion; and a rear leg-plate comprising a length;

a width; and a distal portion;

a sleeve being an open container mounted around the LED and comprising an opening being mounted around the lens;

a base;

a fore mounting hole being formed through the base and mounted around the fore leg-plate;

a rear mounting hole being formed through the base, adjacent to the fore mounting hole and mounted around the rear leg-plate;

a fore mounting guide corresponding to the fore mounting hole, being formed on and protruding from the base and comprising a fore mounting channel being formed through the fore mounting guide, communicating with the fore mounting hole and the opening and being mounted around and holding the fore leg-plate securely;

a rear mounting guide corresponding to the rear mounting hole, being formed on and protruding from the base and comprising a rear mounting channel being formed through the rear mounting guide communicating with the rear mounting hole and the opening, facing away from the fore mounting channel and being mounted around and holding the rear leg-plate securely; and a partition being formed on and protruding from the base between the fore mounting channel and rear mounting channel;

a housing receiving the sleeve and comprising an opening;

a fore terminal channel communicating with the opening and comprising an inner surface; and a rear terminal channel communicating with the opening and the fore terminal channel and comprising;

an inner surface;

a first wire comprising an end; and a first terminal mounted securely on the end, being mounted in the fore terminal channel and electrically contacting a corresponding leg-plate of the LED; and a second wire comprising an end; and a second terminal mounted securely on the end, being mounted in the rear terminal channel and electrically contacting a corresponding leg-plate of the LED.

2. The LED illuminator as claimed in claim 1, wherein the lengths of the fore leg-plate and rear leg-plate are the same and the widths of the fore leg-plate and rear leg-plate are the same.

3. The LED illuminator as claimed in claim 1, wherein the lengths of the fore leg-plate and rear leg-plate are the same and the widths of the fore leg-plate and rear leg-plate are different.

4. The LED illuminator as claimed in claim 1, wherein the widths of the fore leg-plate and rear leg-plate are the same and the lengths of the fore leg-plate and rear leg-plate are different.

5. The LED illuminator as claimed in claim 2, wherein the lengths of the fore leg-plate and rear leg-plate are the different and the widths of the fore leg-plate and rear leg-plate are the different.

6. The LED illuminator as claimed in claim 1, wherein the distal portion of the fore leg-plate and rear leg-plate are respectively bent forwards and backwards over the fore leg-plate and the rear leg-plates;

the mounting guides are beveled; and the partition is also beveled.

7. The LED illuminator as claimed in claim 1, wherein the fore leg-plate comprises a boss being formed on and protruding from the fore leg-plate and abutting the base of the sleeve; and the rear leg-plate comprises a boss being formed on and protruding from the rear leg-plate and abutting the base of the sleeve.

8. The LED illuminator as claimed in claim 7, wherein the first terminal comprises an arced portion being formed on and protruding from the first terminal and contacting the fore leg-plate; and the second terminal comprises an arced portion being formed on and protruding from the second terminal and contacting the rear leg-plate.

9. The LED illuminator as claimed in claim 6, wherein the lengths of the fore leg-plate and rear leg-plate are the same and the widths of the fore leg-plate and rear leg-plate are the same.

10. The LED illuminator as claimed in claim 6, wherein the lengths of the fore leg-plate and rear leg-plate are the same and the widths of the fore leg-plate and rear leg-plate are different.

11. The LED illuminator as claimed in claim 6, wherein the widths of the fore leg-plate and rear leg-plate are the same and the lengths of the fore leg-plate and rear leg-plate are different.

12. The LED illuminator as claimed in claim 6, wherein the lengths of the fore leg-plate and rear leg-plate are the different and the widths of the fore leg-plate and rear leg-plate are the different.

13. The LED illuminator as claimed in claim 8, wherein the lengths of the fore leg-plate and rear leg-plate are the same and the widths of the fore leg-plate and rear leg-plate are the same.

14. The LED illuminator as claimed in claim 8, wherein the lengths of the fore leg-plate and rear leg-plate are the different and the widths of the fore leg-plate and rear leg-plate are the different.

* * * * *